US011851808B2

(12) United States Patent
Pollmann

(10) Patent No.: US 11,851,808 B2
(45) Date of Patent: Dec. 26, 2023

(54) DEVICE FOR TENSIONING A DRAWCORD OF AN IRONING BOARD COVER

(71) Applicant: INPRO B.V., Oisterwijk (NL)

(72) Inventor: Karl Pollmann, Höxter (DE)

(73) Assignee: INPRO B.V.

( * ) Notice: Subject to any disclaimer, the term of this patent is extended or adjusted under 35 U.S.C. 154(b) by 0 days.

(21) Appl. No.: 17/361,813

(22) Filed: Jun. 29, 2021

(65) Prior Publication Data

US 2022/0411990 A1 Dec. 29, 2022

(51) Int. Cl.
*D06F 81/14* (2006.01)

(52) U.S. Cl.
CPC ..... *D06F 81/14* (2013.01)

(58) Field of Classification Search
CPC ..... D06F 81/00; D06F 81/12; D06F 81/14
USPC ..... D6/610
See application file for complete search history.

(56) References Cited

U.S. PATENT DOCUMENTS 973,949 A * 10/1910 Lutz ..... D06F 83/00 248/245
1,368,724 A * 2/1921 Hickey ..... D06F 81/14 38/140
1,586,442 A 5/1926 Dexter
1,930,063 A * 10/1933 Schlesinger ..... D06F 81/00 38/104
2,664,656 A * 1/1954 Pearson ..... D06F 81/14 38/140
2006/0016317 A1* 1/2006 Wilkinson ..... G10D 3/14 84/304

FOREIGN PATENT DOCUMENTS

WO WO-2018042243 A1 * 3/2018 ..... D06F 81/14

OTHER PUBLICATIONS

GB 191008754 A, Oct. 1910, Great Britain, Puthod (Year: 1910).*

* cited by examiner

*Primary Examiner* — Ismael Izaguirre
(74) *Attorney, Agent, or Firm* — Pandiscio & Pandiscio

(57) ABSTRACT

The invention refers to a device for tensioning a drawcord extending along a hem of a cover for an ironing board underneath the ironing board, comprising a drum pivoted around an axis of rotation, which is surrounded by a lateral surface for winding up the drawcord, wherein a through-hole passes through the drum perpendicular to the axis of rotation for threading in at least one end of the drawcord in order to anchor it to the drum.

31 Claims, 2 Drawing Sheets

DEVICE FOR TENSIONING A DRAWCORD OF AN IRONING BOARD COVER

FIELD OF THE INVENTION

The invention refers to a device for tensioning a drawcord extending along a hem of a cover for an ironing board underneath the ironing board, comprising a drum pivoted around an axis of rotation, which is surrounded by a lateral surface for winding up the drawcord.

BACKGROUND OF THE INVENTION

A generic device is disclosed in U.S. Pat. No. 1,586,442. According to this former invention, in order to fix a cover to an ironing board, a plate is secured at the underside of this board, and a drum is journaled on said plate. A handle allows a person to rotate said drum for the purpose of winding the drawcord of said cover around the drum, whereby the drawcord shall be tensioned in order to fix the cover at the ironing board. On the other hand, there is no possibility to anchor the drawcord to the drum, and as a result, the drawcord will always tend to slip along the lateral surface of the drum instead of being wound around the drum. After a full rotation at the earliest, an inner winding can be pressed against the lateral surface of the drum by an outer winding, thereby installing a frictional engagement between the cord and the drum.

From the disadvantages of the state of the art, the problem initiating the invention arises, namely to improve a device for tensioning a cord of an ironing board cover in that it can be anchored to a drum with less effort in such a way that it will not slip along the lateral surface in case of a rotation of the drum, but will be wound around the drum in a detachable way.

SUMMARY OF THE INVENTION

The solution of this problem is achieved in that a through-hole passes through the drum perpendicularly to the axis of rotation for threading in the ends of the drawcord in order to anchor them to the drum.

The through-hole allows a person to thread one or both ends of a cord transversely through the drum and to hold it in tight contact with the lateral surface of the drum when the latter is rotated. As the cord extends completely through the drum, even in the case of only one cord end threaded through the drum, both strands of one cord end, which extend on both sides of the through-hole, will be wound on the lateral surface of the drum simultaneously, and therefore, after a half rotation of the drum, an outer strand winding will superimpose an inner strand winding and thereby securing the cord to the drum in a frictionally engaged manner.

It has been proved to be advantageous that the drum has an elongated shape. Such a design ensures that the perimeter of the drum is rather small, and therefore, only a small length of a drawcord has to be wound up in order to fix the drawcord to the drum.

The through-hole should have an elongated cross-section, whose longest extension is parallel to the longitudinal axis of the drum. Due to such an arrangement, both ends of the drawcord of the ironing board cover can be threaded through this through-hole simultaneously or side by side, respectively.

In order to improve the handling of the device according to the invention, the length of the cross-section of the through-hole should be sized at least 1.5 times larger than the greatest width of the cross-section of the through-hole, or at least 2 times larger than the width of the cross-section of the through-hole. Then, every drawcord can be threaded twice into such through-hole, which has a cross-section equal to or less than half of the cross-section of the through-hole.

Sharp edges between the through-hole and the lateral surface of the drum should be avoided in order to prevent a cutting or ripping of the drawcord at such an edge. Therefore, these edges can be rounded, or can be rounded with a radius of curvature of at least 0.5 mm.

Further advantages can be achieved, if the lateral surface of the drum extends between to end faces of the drum and tapers from these end faces to the middle of the drum, especially along two conical surfaces. Then, the windings of the drawcord on the drum will be concentrated at the middle of the drum, and the second winding will overlie the first winding and will press it against the lateral surface of the drum in a frictionally engaged manner.

The lateral surface of the drum can be delimited in the longitudinal direction by projecting flanges at one or both end faces of the drum. Such flanges ensure that the drawcord cannot slip from the drum at its end faces.

In order to stabilize the orientation of the axis of rotation of the drum as well as its actual angular positioning, the drum should be rotatably mounted in a chassis or housing.

For the arrangement of a first bearing between the drum and the chassis or housing, the latter may comprise at least a first plate with a circular hole for receiving a portion of the drum in such a way that the longitudinal axis of the drum is perpendicular to the plane of the plate.

Additionally, the chassis or housing may comprise a second plate which is parallel to the first plate, and both plates comprise a circular hole each which are in alignment with each other for receiving a portion of the drum. In such a way, the drum is mounted at or near its two end faces and thereby, the axis of rotation is fixed in an until table manner with regard to the chassis or housing.

The invention recommends that the distance between the turned-away sides of the first and second plates should be no more than the distance between the facing sides of the flanges at both end faces of the drum. In this case, it is possible to arrange the flanges at both end faces of the drum beyond the turned-away sides of the first and second plates of the chassis or housing, and then, the drum is mounted rotatable around the axis of rotation, but cannot be displaced along the direction of the axis of rotation.

A similar, but more complicated embodiment can be realized, if the distance between the turned-away sides of the of the flanges at both end faces of the drum is no more than the distance between the facing sides of the first and second plates. In this case, it is possible to arrange the flanges at both end faces of the drum between the facing sides of the first and second plates of the chassis or housing, and then, the drum cannot be displaced along the direction of the axis of rotation, too, while the bearing of the drum has to be done in a different manner in this case.

A way to hold the first and second plates at a constant distance is by use of a lateral surface of a housing, which, in combination with the first and second plates, forms a first chamber receiving and housing the drum in a rotatable manner. The first and second plate can be formed integrally with the lateral surface of the housing or can be connected thereto, for example by adhesive.

In order to be able to wind the drawcord onto the drum rotatably mounted inside the first chamber, the lateral surface of the first chamber housing the drum should be provided with two aligned holes, which can be further aligned with the through-hole of the drum at a special angular position of the drum relative to the housing. The cross-section of each of these holes can be similar or identical to the cross-section of the through-hole in the drum.

The winding of the drawcord onto the drum is achieved by rotating the drum relative to the housing. This can be done by use of a twist grip attached to the drum in the area of one end face of the drum, either at the outside of the regarding end face, or at the outside of a flange at the regarding end face, or beyond a first plate of the chassis or housing near the regarding end face of the drum.

The device according to the invention can be further improved by providing the chassis or housing with a third plate beyond the second plate, wherein the third plate is parallel to the second plate. These second and third plates can be held at a constant distance by a lateral surface of the housing, which, in combination with the second and third plates, forms a second chamber for receiving additional mechanical elements of the device according to the invention.

Such an additional mechanical element of the device according to the invention may be a ratchet mechanism, which enables a rotation of the drum around the axis of rotation only in one direction. After winding the drawcord onto the drum by rotating the latter in the direction of rotation permitted by the ratcheting mechanism, this ratchet mechanism will lock the actual position of the drum against a rolling back, and therefore, the drawcord cannot unwind from the drum spontaneously.

On the other hand, if the cover shall be removed from the ironing board, the drawcord has to be released. This is accomplished by an override mechanism for the ratchet mechanism which, if activated, deactivates the ratchet mechanism and enables a rotation of the drum around the axis of rotation in both directions.

In order keep the mechanical elements of the ratchet mechanism and of the override mechanism always in a functional engagement, one or both of the ratchet mechanism and/or the override mechanism can be housed in the second chamber of the housing, protected against the surroundings by the housing.

As a part of such a ratchet mechanism, the drum may be equipped with a bar-shaped extension, which projects from the regarding end face of the drum in a direction parallel and coaxial to the axis of rotation, and has a cross-shaped or star-shaped cross-section.

Such a bar-shaped projection may be used as a guiding for a ratchet body with a recess in the form of a tunnel or a blind hole which fits over the bar-shaped extension of the drum in an interlocking manner in order to prevent a relative rotation between the ratchet body and the drum, although a relative displacement of the ratchet body relative to the drum is possible in the longitudinal direction of the drum.

According to a preferred embodiment, the ratchet body comprises a cylindrical section and a collar protruding over the cylindrical section in a radial direction. Such cylindrical section of the ratchet body can act as a guidance for a helical spring which can be shifted onto the cylindrical section, while the radially protruding collar can act as a stop which delimits the longitudinal movement of the helical spring relative to the ratchet body.

If the collar is situated near the end face of the ratchet body adjacent to the third plate, a helical compression spring can be stuck over the cylindrical section of the ratchet body between a flange of the drum near the second plate on the one hand and the collar of the ratchet body on the other hand. At such an arrangement, the helical compression spring urges the ratchet body in a direction against the third plate of the housing.

Such a pressing force between the end surface of the ratchet body and the third plate may induce a contemplation over providing an engagement between these elements, especially in the form of a row of saw teeth at the end surface of the ratchet body, which saw teeth can project against the third plate.

Such an embodiment may be further improved by arranging the row of saw teeth in such a way that the row extends along a circle at the periphery of the end face of the ratchet body. Upon rotation of the ratchet body, the saw teeth in such a row do not alter their position relative to a center of the end face of the ratchet body, but only their angular position around the axis of rotation.

As functional pendants to the saw teeth at the ratchet body, one or more additional saw teeth can be provided at the surface of the third plate facing towards the ratchet body. Such an arrangement enables a relative rotation between the ratchet body and the third plate of the housing only in a direction where the inclined surfaces of the saw teeth can move relative to each other, by pressing the ratchet body away from the third plate temporarily.

The override mechanism of such ratchet mechanism primarily comprises a press button received within a circular hole of the third plate. Preferably, such a press button can be a central protrusion formed integrally with the ratchet body beyond the radially protruding collar.

As this press button extends through the third plate of the housing, it is accessible from outside and can be pressed inwardly, against the force of the helical compression spring, in order to displace the ratchet body towards the drum. In doing so, the saw teeth of the ratchet body are released from the saw teeth of the housing, and a rotation of the ratchet body and the drum as well is enabled in both directions relative to the housing.

Finally, the teaching of the present invention is that the housing is assembled from two halves which can be snapped together. Preferably, the common separation plane between the two halves of the housing extends along the axis of rotation of the drum. Then, the aligned holes of the one to third plate are separated at their maximum diameter, and the drum with ratchet body and spring can be inserted into one half of the housing before snapping the second half of the housing onto the first, whereby the rotatable mounting of the drum and ratchet body in the housing is completed.

BRIEF DESCRIPTION OF THE DRAWINGS

Further features, details, advantages and effects on the basis of the invention will be seen from the following description of a preferred embodiment of the invention as well as from the drawing. Therein.

DETAILED DESCRIPTION OF THE PREFERRED EMBODIMENTS

Figure 1:
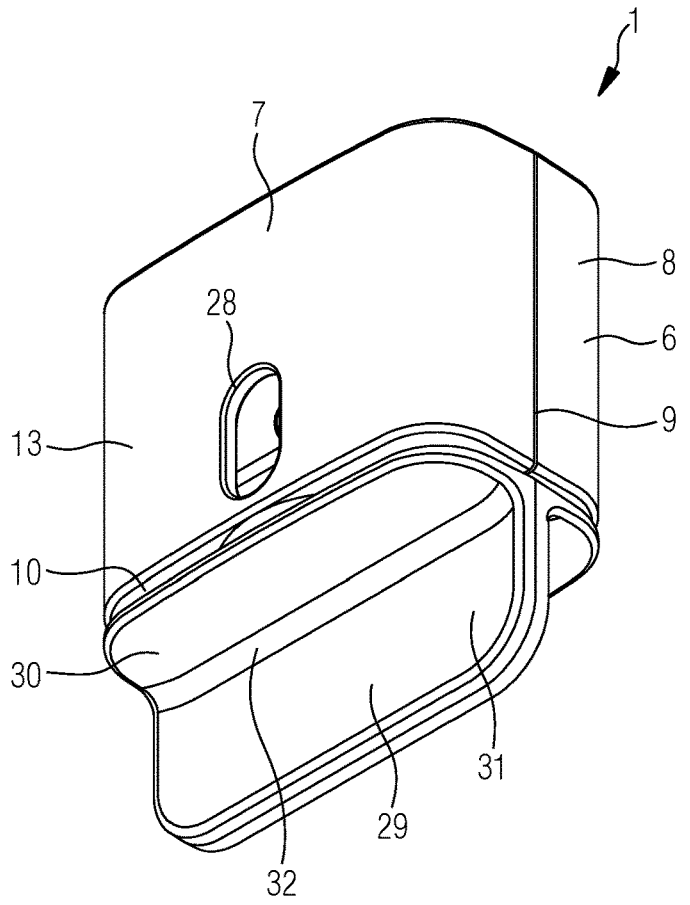
FIG. 1 is a perspective view of a device for tensioning a cord of an ironing board cover according to the invention, consisting of a housing and a twist grip, where it can be seen that the housing of the device consists of two identical halves which are assembled with each other along a vertical symmetrical plane.
Figure 2:
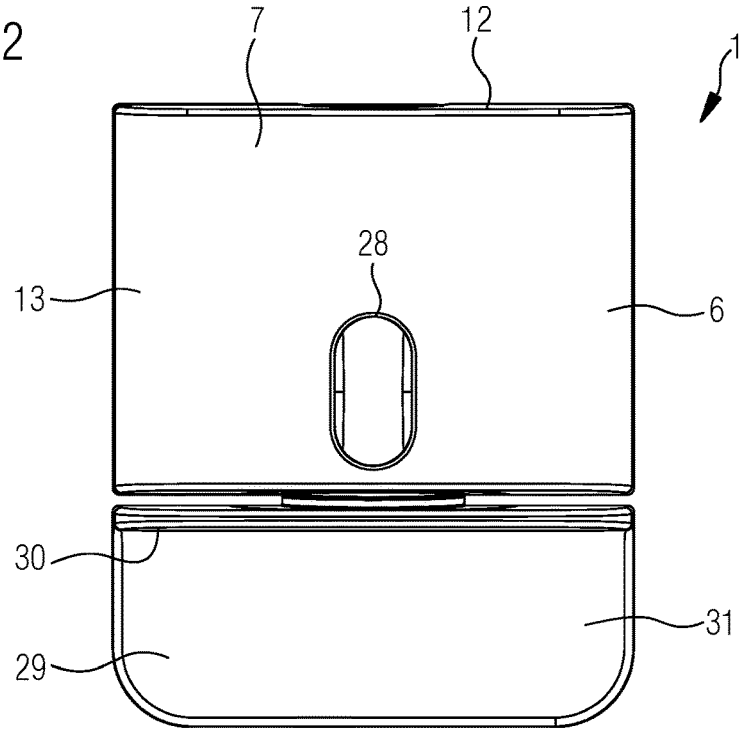
FIG. 2 is a front view of the device according to FIG. 1, showing the exterior surface of one half of the housing of the device together with the twist grip.

The device 1 shown in the drawing can be used to fix a cover to an ironing board, especially by tensioning a drawcord, which extends along a hem of the cover underneath the ironing board.

For this purpose, the device 1 comprises a drum 2 pivoted around an axis of rotation 3, which is surrounded by a lateral surface 4 for winding up the drawcord and comprises a through-hole 5 for threading through the drawcord before rotating the drum 2.

For a precise orientation of the axis of rotation 3, the drum 2 is mounted in a rotatable manner inside of a housing 6. This housing is assembled from two halves 7, 8, which are in contact with each other along a common contact or separation plane 9.

Figure 3:
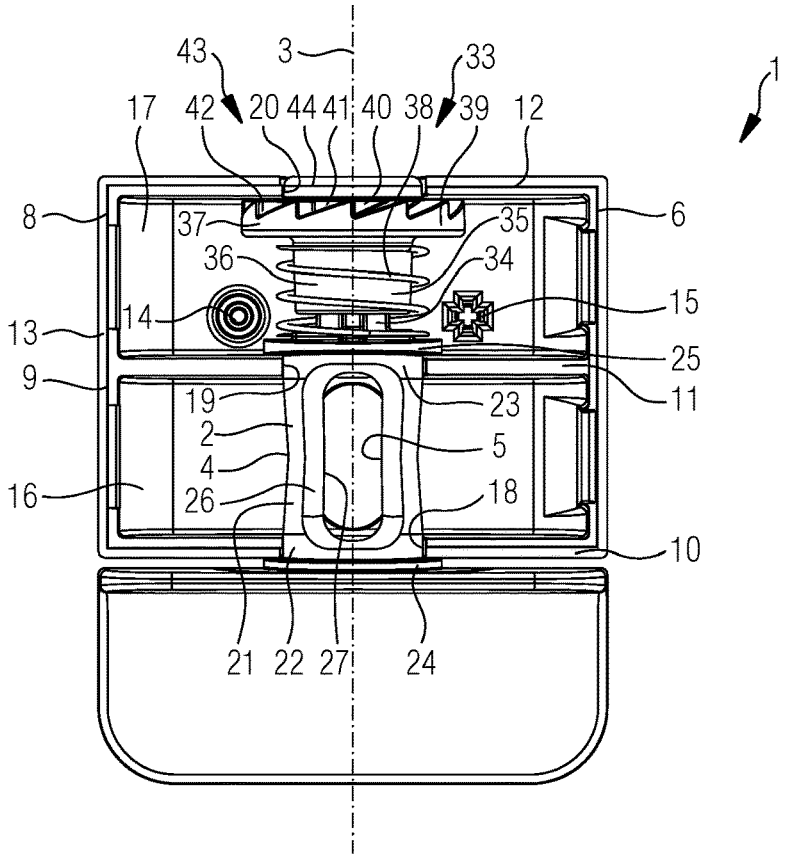
FIG. 3 is a view onto the inside of one of the two halves of the housing before the assembly, but where the twist grip has already been inserted.
Figure 4:
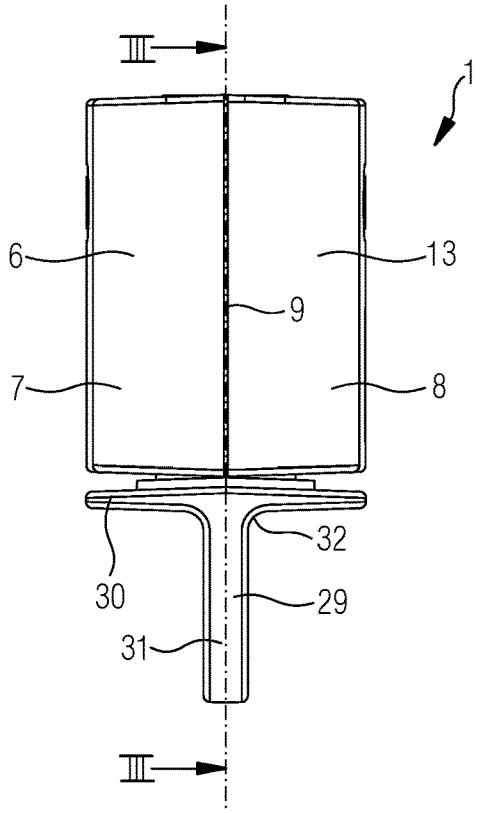
FIG. 4 is a lateral view of the device according to FIG. 1.

As can be seen best in FIG. 3, where the housing 6 is opened. The complete housing 6 consists of three parallel plates 10, 11, 12, namely a first plate 10, which is the lowermost one in FIG. 3, a second plate 11 in the middle of FIG. 3, and a third plate 12 at the top of FIG. 3. These three plates 10, 11, 12 are connected to each other via a lateral surface 13 of the housing 6.

Although these plates 10, 11, 12 as well as the lateral surface 13 are all referred to as one part in the specification, it should be noted that, for the purpose of a simple assembly of the device 1, they are all divided into two halves, each of which is a part of one of the two housing halves 8, 9.

Furthermore, to allow a quick assembly of the housing 6 from its two halves 7, 8, there are projections 14, 15 provided at the inner surfaces 16 of the two halves 7, 8, which fit precisely together with the projections 14, 15 of the opposite half 8, 7 as pendants. These projections 14, 15 of different halves 7, 8 may be snapped together by a light pressure onto the two housing halves 7, 8, so that ideally, the housing 6 can be assembled without any adhesive, within a few seconds.

The lateral surface 13 may be formed with rounded edges, which is a matter of minimizing any risk of injury.

Furthermore, all plates 10, 11, 12 have the same area and shape, and therefore, the cross-section of the housing 6 is constant over its entire length or height, respectively.

As can be seen from FIG. 3, the interior of the housing 6 is divided into two chambers 16, 17. A first chamber 16 is formed by the first plate 10, the second plate 11 and a lower part of the lateral surface 13, whereas a second chamber 17 is encompassed by the second plate 11, the third plate 13 and an upper part of the lateral surface 13. The volumes of both chambers 16, 17 can be identical or nearly identical.

As the geometry of all plates 10, 11, 12 is rectangular, preferably with rounded corners, both chambers 16, 17 have an elongated shape, with a horizontal length extending parallel to the separation plane 9, while the width as well as the height of each chamber 16, 17 is substantially shorter than the regarding length.

Both chambers 16, 17 communicate with each other through a central opening 19 in the second plate 11. This central opening 19 is aligned with a central opening 18 in the first plate 10 and with a central opening 20 in the third plate 12. In the following, the central opening 18 in the first plate 10 will be denoted as first opening 18, the central opening 19 in the second plate 11 will be denoted as second opening 19, and the central opening 20 in the third plate 12 will be denoted as third opening 20. The first and second openings 18, 19 have a circular cross-section, and preferably the third opening 20, too.

A body 21 comprising the drum 2 extends through the first and second openings 18, 19.

The central portion of this body 21 is formed by the drum 2. Preferably, the lateral surface 4 of the drum 2 is not in the form of a cylindrical casing, but it is shaped like two antiparallel conical surfaces which are connected at their tapered ends. This results in a geometry of the drum 2 with the lateral surface 4 being tapered in the middle between two end portions 22, 23.

These two end portions 22, 23 are in the form of flat cylindrical discs with a cylindrical perimeter, and preferably, the diameter of the drum 2 converges to the diameter of the regarding end 22, 23 and merges into the regarding cylindrical end 22, 23 without any step.

The distance between the two cylindrical end portions 22, 23 is identical to the distance between the first and second plate 10, 11. Furthermore, as the diameter of the two cylindrical end portions 22, 23 of the body 21 is the same as the diameter of the first and second opening 18, 19, the cylindrical end portions 22, 23 can be received in the first and second openings 18, 29 like a shaft in friction bearings.

In order to hold the body 21 comprising the drum 2 in place and to prevent a longitudinal displacement thereof, both cylindrical end portions 22, 23 are delimited in the longitudinal direction between the conical lateral surface 13 of the drum on the one hand and an adjoining flange 24, 25 with a greater diameter on the other hand.

These adjoining flanges 24, 25 extend along the first and second plates 10, 11 outside of the first chamber 16. As the diameter of these flanges 24, 25 is even greater than the diameter of the first and second openings 18, 19, they cannot slip through the first and second openings 18, 19, but hold the drum 2 of the body 21 in position between the first and second plates 10, 11—that is inside of the first chamber 16. The only permitted movement relative to the housing 6 of the body 21 comprising the drum 2 is a rotation around the axis of rotation 3.

The drum 2 is equipped with a through-hole 5 for threading through a two ends of a drawcord of a ironing board cover. This through-hole 5 has an elongated cross-section extending through the lateral surface 4 of the drum 2 between both cylindrical end portions 22, 23. The cross-section of this through-hole 5 is rounded, as well as the edges 26 between the inner side 27 of the through-hole 5 and the lateral surface 4 of the drum 2, in order to avoid any sharp edges which could harm a drawcord threaded into the through-hole 5.

In order to enable such a threading of the ends of a drawcord into the through-hole 5, the lateral surface 13 of the housing 6 is provided with two holes 28, preferably elongated holes which are similar in shape to the cross-section of the through-hole 5, and which are aligned with the through-hole 5, if the body 21 is in an angular position where the orientation of a line traversing the drum 2 along the through-hole 5 is perpendicular to the lateral surface 13 of the housing adjacent to the drum 2.

So, in such an angular position of the body 21, the ends of a drawcord can be threaded directly through the housing 6 from one side to the other side, and accurate through the through-hole 6 in the drum 2. In order to find this angular position easily, the end portion 22 near the first plate 10 is equipped with a twist grip 29.

The twist grip 29 comprises a base plate 30 which is parallel to the first plate 10 and has the same size and shape as the first plate 10, especially a rectangular shape was rounded corners, and further a grip plate 31 projecting perpendicularly from the base plate 30 outwards along a linking line 32. The grip plate 31 is used as the actual grip and may be grasped between two fingers or between the thumb and the forefinger.

The twist grip 29 is formed integrally with the body 21 or is fixed thereto in a torque-proof manner, in a position where the orientation of a line traversing the drum 2 along the through-hole 5 is perpendicular to the grip plate 31. Therefore, in a relative position, where the linking line 32 is aligned with the separation plane 9 of the housing 6, the through-hole 5 is aligned with the holes 29 in the housing 6, and a drawcord can be threaded entirely through the housing 6 of the device 1.

After feeding the drawcord through the device 1 in this manner, the grip 29 can be twisted in order to rotate the drum 2 and to wind the drawcord onto the lateral surface 4 of the drum 2. A further mechanism is required to lock an angular position of the drum 2 after the ends of the drawcord have been wound around the drum 2 and the drawcord has been tensioned in this way. This mechanism is a ratchet mechanism 33 which is arranged in the second chamber 17 of the housing 6.

One element of the ratchet mechanism 33 is a protrusion or bar-shaped extension 34 of the body 21 which extends beyond the second flange 25 and is parallel to the longitudinal axis or axis of rotation 3 of the drum 2. This bar-shaped extension 34 has a cross-shaped or star-shaped cross-section and is used as a guidance for a ratchet body 35.

The ratchet body 35 is provided with a recess in the form of a tunnel or a blind hole which fits over the bar-shaped extension of the drum. The cross-section of the recess in the ratchet body 35 is identical or similar to the cross-section of the bar-shaped extension 34. Therefore, the ratchet body 35 is permitted to slide along the bar-shaped extension 34, but cannot twist relative to the drum body 21.

Furthermore, the ratchet body 35 comprises a cylindrical portion 36 facing the second flange 25 of the drum body 21, and a collar 37 extending radially outwards from the cylindrical portion 36 near the third plate 12 of the housing 6.

A helical compression spring 38 is stuck over the cylindrical portion 36 of the ratchet body 35, especially between the regarding flange 25 of the drum body 21 near the second plate 11 on the one hand and the collar 37 of the ratchet body 35 on the other hand and urges the ratchet body 35 apart from the drum body 21.

The collar 37 is provided at its end face facing away from the drum body 21 with a row of saw teeth 39. This row extends completely around the collar's circumference of the collar 37, and all saw teeth 39 have the same shape and are lined up along the row in the same direction.

One or more saw teeth 40 are provided at the inner side of the third plate 12 as pendants to the saw teeth 39 in the row at the ratchet body 35. Therefore, if the twist grip 29 is rotated in a direction where the inclined edges 41 of the saw teeth 39, 40 are shifted over each other, the drum body 21 can be rotated, because the ratchet body 35 is urged by the saw teeth 39, 40 towards the second plate 11. In the other direction, the vertical edges 42 of the saw teeth prevent any rotation of the drum body 21.

On the other hand, a release mechanism is necessary in case the drawcord shall be released. This is achieved by an override mechanism 43 which is realized by an elevated press button 44 at the center of the end face of the collar 37 facing away from the cylindrical portion 36. This press button 44 has a diameter equal to or smaller than the third opening 20 in the third plate 12, and protrudes through this opening 20 to the outside of the housing 6. If this press button 44 is pressed, the ratchet body 35 is urged towards the drum 2 and the saw teeth 39 of the ratchet body 35 are freed from the saw teeth 40 at the third plate 12, thereby allowing a rotation of the ratchet body 35 in any direction. This degree of freedom is transferred onto the drum body 21 which is allowed to rotate in both directions, too.

REFERENCE NUMERALS

1 device
2 drum
3 axis of rotation
4 lateral surface
5 through-hole
6 housing
7 half
8 half
9 separation plane
10 first plate
11 second plate
12 third plate
13 lateral surface
14 projection
15 projection
16 first chamber
17 second chamber
18 first opening
19 second opening
20 third opening
21 drum body
22 cylindrical end portion
23 cylindrical end portion
24 flange
25 flange
26 edge
27 inner side
28 hole
29 twist grip
30 base plate
31 grip plate
32 linking line
33 ratchet mechanism
34 bar-shaped extension
35 ratchet body
36 cylindrical portion
37 collar
38 helical compression spring
39 saw tooth
40 saw tooth
41 inclined edge
42 vertical edge
43 override mechanism
44 press button

The invention claimed is:

1. A device (1) for tensioning a drawcord extending along a hem of a cover for an ironing board underneath the ironing board, comprising a drum (2) which is rotatably mounted in a chassis or housing (6) pivotable around an axis of rotation (3), which is surrounded by a lateral surface (4) for winding up the drawcord, characterized by a through-hole (5) passing through the drum (2) perpendicularly to the axis of rotation (3) for threading in at least one end of the drawcord in order to anchor it to the drum (2), wherein edges (26) between the through-hole (5) and the lateral surface (4) of the drum (2) are rounded.

2. The device (1) according to claim 1, wherein the drum (2) has an elongated shape.

3. The device (1) according to claim 1, wherein the through-hole (5) has an elongated cross-section, whose longest extension is parallel to the longitudinal axis of the drum (2).

4. The device (1) according to claim 3, wherein the length of the cross-section of the through-hole (5) is at least 1.5 times larger than the width of the cross-section of the through-hole (5), or is at least 2 times larger than the width of the cross-section of the through-hole (5).

5. The device (1) according to claim 1, wherein the edges (26) between the through-hole (5) and the lateral surface (4) of the drum (2) are rounded with a radius of curvature of at least 0.5 mm.

6. The device (1) according to claim 1, wherein the lateral surface (4) of the drum (2) extends between two end faces of the drum (2) and tapers from these end faces to the middle of the drum (2), especially along two conical surfaces.

7. The device (1) according to claim 1, wherein the lateral surface (4) of the drum (2) is delimited in the longitudinal direction by projecting flanges (24,25) at one or both end faces of the drum (2).

8. The device (1) according to claim 1, wherein the chassis or housing (6) comprises at least a first plate (10) with a circular hole (18) for receiving a portion of the drum (2) in such a way that the longitudinal axis (3) of the drum (2) is perpendicular to the plane of the plate (10).

9. The device (1) according to claim 8, wherein the chassis or housing comprises a second plate (11) which is parallel to the first plate (10), and both plates (10, 11) comprise a circular hole (18, 19) each for receiving a portion of the drum (2).

10. The device (1) according to claim 9, wherein the distance between the non-facing sides of the first and second plates (10, 11) is no more than the distance between the facing sides of the flanges (24, 25) at both end faces of the drum (2).

11. The device (1) according to claim 10, wherein the flanges (24, 25) at both end faces of the drum (2) are beyond the non-facing sides of the first and second plates (10, 11) of the chassis or housing (6).

12. The device (1) according to claim 9, wherein the first and second plates (10, 11) are held at a constant distance by a lateral surface (13) of the housing (6), which forms in combination with the first and second plates (10, 11) a first chamber (16) housing the drum (2).

13. The device (1) according to claim 12, wherein the lateral surface (13) of the first chamber (16) housing the drum (2) comprises two aligned holes (28), which are aligned with the through-hole (5) of the drum (2) at a special angular position of the drum (2) rotatably mounted inside the first chamber (16).

14. The device (1) according to claim 1, wherein a twist grip (29) is attached to the drum (2) in the area of one end face of the drum (2), either at the outside of the regarding end face, or at the outside of a flange (24,25) at the regarding end face, or beyond a first plate (10) of the chassis or housing (6) near the regarding end face of the drum (2).

15. The device (1) according to claim 9, wherein the chassis or housing (6) comprises a third plate (12) beyond the second plate (11), wherein the third plate (12) is parallel to the second plate (11).

16. The device (1) according to claim 15, wherein the second and third plates (11,12) are held at a constant distance by a lateral surface (13) of the housing (6), which forms in combination with the second and third plates (11,12) a second chamber (17).

17. The device (1) according to claim 1, further comprising a ratchet mechanism (33), which enables a rotation of the drum (2) around the axis of rotation (3) only in one direction.

18. The device (1) according to claim 17, further comprising an override mechanism (43) for the ratchet mechanism (33) which, if activated, deactivates the ratchet mechanism (33) and enables a rotation of the drum (2) around the axis of rotation (3) in both directions.

19. The device (1) according to claim 17, wherein the ratchet mechanism (33) and/or an override mechanism (43) is housed in a Ere second chamber (17) of the housing (6).

20. The device (1) according to claim 1, wherein the drum (2) comprises a bar-shaped extension (34) projecting parallel and coaxial to the axis of rotation (3) and having a cross-shaped or star-shaped cross-section.

21. The device (1) according to claim 20, further comprising a ratchet body (35) with a recess in the form of a tunnel or a blind hole which fits over the bar-shaped extension (34) of the drum (2) in an interlocking manner in order to prevent a relative rotation between the ratchet body (35) and the drum (2), although a relative displacement in the longitudinal direction of the ratchet body (35) relative to the drum (2) is possible.

22. The device (1) according to claim 21, wherein the ratchet body (35) comprises a cylindrical section (36) and a collar (37) protruding over the cylindrical section (36) in a radial direction.

23. The device (1) according to claim 22, wherein the collar (37) is situated near the end face of the ratchet body (35) adjacent to the third plate (12).

24. The device (1) according to claim 23, wherein a helical compression spring (38) is stuck over the cylindrical section (36) of the ratchet body (35), especially between a flange (25) of the drum (2) near the second plate (11) on the one hand and the collar (37) of the ratchet body (35) on the other hand.

25. The device (1) according to claim 24, wherein the helical compression spring (38) urges the ratchet body (35) in a direction towards the third plate (12) of the housing (6).

26. The device (1) according to claim 25, wherein the end surface of the ratchet body (35) facing the third plate (12) comprises a row of saw teeth (39) projecting against the third plate (12).

27. The device (1) according to claim 26, wherein the row of saw teeth (39) extends along the periphery of the end face of the ratchet body (35).

28. The device (1) according to claim 26, wherein the surface of the third plate (12) facing towards the ratchet body (35) comprises one or more saw teeth (40) as pendants to the saw teeth (39) at the ratchet body (35), in order to enable a relative rotation only in a direction where the inclined surfaces (41) of the saw teeth (39,40) can move relative to each other.

29. The device (1) according to claim 15, wherein the third plate (12) comprises a circular hole (20) for receiving a press button (44) of the override mechanism (43).

30. The device (1) according to claim 29, wherein the press button (44) can be pressed against the force of the helical compression spring (38) in order to free the saw teeth (39,40) from each other and to enable a rotation of the ratchet body (35) relative to the housing (6) in both directions.

31. The device (1) according to claim 1, wherein the housing (6) is assembled from two halves (7,8) which can be snapped together.

* * * * *